United States Patent [19]

Genoud et al.

[11] Patent Number: 4,747,813

[45] Date of Patent: May 31, 1988

[54] DEVICE FOR FOLDING A REAR FLAP OF A BOX BLANK

[75] Inventors: Jean-Marc Genoud, Bussigny; Ivan Vaclavik, Cugy, both of Switzerland

[73] Assignee: Bobst SA, Switzerland

[21] Appl. No.: 37,874

[22] Filed: Apr. 13, 1987

[30] Foreign Application Priority Data

Apr. 15, 1986 [CH] Switzerland ..... 1488/86

[51] Int. Cl.[4] ..... B31B 1/26; B31B 3/54

[52] U.S. Cl. ..... 493/10; 493/23; 493/177; 493/436

[58] Field of Search ..... 493/8, 10, 23, 177, 493/183, 425, 436, 453, 476

[56] References Cited

U.S. PATENT DOCUMENTS 3,330,185 7/1967 Annett et al. ..... 493/425
4,092,906 6/1978 Linner ..... 493/177
4,432,745 2/1984 Eldridge ..... 493/10
4,539,002 9/1985 Zak ..... 493/23
4,629,445 12/1986 Toriyama ..... 493/10

FOREIGN PATENT DOCUMENTS 3318882 12/1983 Fed. Rep. of Germany ..... 493/177

*Primary Examiner*—Frederick R. Schmidt
*Assistant Examiner*—William E. Terrell
*Attorney, Agent, or Firm*—Hill, Van Santen, Steadman & Simpson

[57] ABSTRACT

A device for folding a rear flap on a box blank characterized by the rotating members and their shaft being mounted in a cradle which is shifted in the frame relative to the path of the blank having the flap being folded. The shifting of the cradle is controlled by a stepping motor. The rotation of the folding members, as well as the position of the drive shaft for the folding members is controlled in accordance to the position of a hitting point of contact for the ends of the hook members with the flap relative to the creasing line.

9 Claims, 8 Drawing Sheets

DEVICE FOR FOLDING A REAR FLAP OF A BOX BLANK

BACKGROUND OF THE INVENTION

The present invention is directed to a device for folding a rear flap on a box blank as the box blank is moving in a path through the folding machine.

Devices for folding flaps of a box blank with a rotative folding member, which is mounted on an intermittently rotatable shaft with the rotatable folding member having two folding hooks on each side of the shaft, are known. These folding hooks are mounted opposite to one another on the central axis and are laterally shiftable along the shaft. The box blank is moved along a path over the rotatable folding member so that the hook can hit the flap from beneath the flap and fold it over while the box blank is being moved thereover. The speed of rotation for the shaft and the member is varied by means of cams and levers so that the hook, after engaging the flap, will be moving at a slightly higher speed than the box blank. When folding the flap, the hook should hit it in a given area, which it lies generally at about two thirds of the flaps length taken from the creasing line on which the folding will occur. The shaft of the rotatable folding member is positioned at a given distance from the plane on which the blanks are moving. The length of the hook, for example, the radius of a circle on which the end of the hook moves and the distance between the intermittent shaft and the extremeties of the folding hook has to be adapted either by changing the length of the mounting arm for the hook or by mounting the hook member on the central axis with thickness blocks to make sure that the hook acts in the wanted area of the flap for the given length of time.

U.S. Pat. No. 3,330,185, whose disclosure is incorporated by reference thereto, discloses a device such as discussed hereinabove. The main drawbacks of this device is that there are difficulties in positioning the folding hooks in the wanted areas and the device has a relatively long set-up time required to mount the hooks on the intermittently rotatable axle or shaft.

SUMMARY OF THE INVENTION

The present invention overcomes the drawbacks with the previously known devices by providing a rotative folding member which is easily and quickly positioned in accordance with the size of the flap on the blank which is being processed.

To accomplish these goals, the present invention is directed to an improvement in a device for folding a flap on a back edge of a box blank, said device including means for conveying the blank along a path over a frame having a rotatable shaft having a rotatable member with two folding hooks facing in the same direction of rotation for engaging the rear flap and folding the rear flap over onto the blank as the blank moves along the path. The improvements include a cradle having two side plates being mounted in the frame for slidable movement in a slide path extending perpendicular to the path of the blank, a drive motor being connected by a speed reducer to said rotatable shaft, said motor, speed reducer and shaft being mounted in said cradle, means for shifting the cradle on said slide path and said rotatable member being axially adjustable on the shaft. Preferably, the device includes means for axially adjusting the rotatable member with the hook members on the shaft including a motor rotating a shifting screw, a fork threaded on said screw engaging the rotatable member for shifting the member and the hook members laterally along the axis of the shaft. The means for shifting the cradle on said slide path include a setting screw threadably engaging each of the side plates, each of said setting screws having a conical pinion, said conical pinions engaging conical pinions on a control axle, and a motor acting on said control axle to simultaneously rotate both setting screws together. Preferably, the motor for the means for adjusting is a stepping motor that receives pulses from a pulse convertor, said pulse convertor receiving a signal from a comparator comparing a fixed radius for the hook members against the measured distance between the contact of the hook member and the fold line for the flap to determine the necessary distance between the axle of the rotatable shaft for the rotating hook members and the blank.

The drive motor for rotating the shaft is driven in response to a generator which receives a detection signal from a electrical photocell determining the distance between the point of contact and the fold line for the flap.

Other advantages and features of the invention will be readily apparent from the following drawings, description of the invention and claims.

DESCRIPTION OF THE PREFERRED EMBODIMENTS

Figure 1:
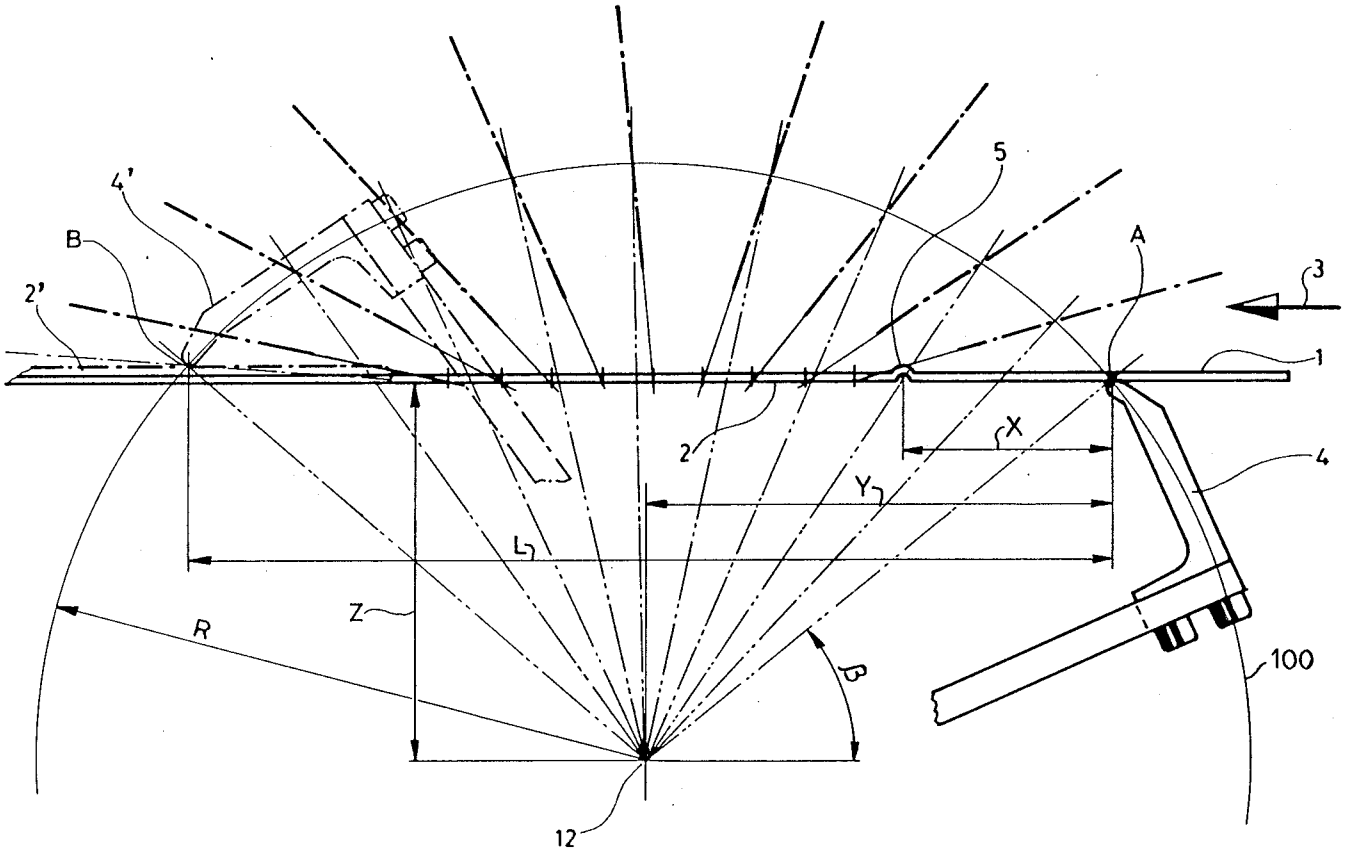
FIG. 1 is a schematic view illustrating movement of the folding member, and the flap between the beginning of the folding operation to the completion of the folding operation for a large flap.

The principals of the present invention are particularly useful when folding a rear flap on a box blank. As illustrated in FIG. 1, a box blank 2 having a large rear flap 1 is transported in a plane in a direction of arrow 3 through the device of the present invention. An end of a folding hook 4 engages a bottom surface of the flap 1 at a point A which has a distance X from a crease 5, which distance X is usually equivalent to two thirds of the length of the flap when measured from the free end to the crease or folding line 5. The end of the hook 4 moves in a circular path 100 having a radius R which passes through the point A and is a constant value so that it has the same length. A theoretical axis 12 for the shaft for the folding member 4 can be defined by the values Y and Z and will vary with regard to the position of the hitting point A of the hook 4 against the rear flap 1 (X value). The operating area of the hook 4 is determined by the value L and starts at the hitting point A and ends at the corresponding point B wherein the hook has folded the flap 1 to the folded position 2', as illustrated by the hook 4' in chain lines. While in the value or path L, the hook 4 will move between these two points according to the diagram of FIG. 3, wherein time t is reported in 1/1000 seconds on the x-axis and the rotational angle $\alpha$ of a drive shaft supporting the folding member 4 is on the y-axis. The hook 4 will hit the rear flap 1 at a time t1=0.022 seconds, which is shown as point A in FIG. 1. The linear value of the circumferential speed of the end of the hook 4 is equivalent to the linear speed of the blank at the time it hits the blank. No shifting can thus occur between the hook 4 and the rear flap. The choice of the curves only depends on the necessity to draw an acceleration curve $d^2\alpha/dt^2$ suiting the concerned mass. The extremity or end of the hook 4 has processed the flap and is now lying in the position 4' of FIG. 1, which is the release point B corresponding to the time t2=90.2 on the diagram of FIG. 3. At this position, the rotation of the hook is stopped in order to release the folded box 2'. The difference between the time t1 and the time t2 is the value L representing the working area of the hook 4. The acceleration and speed curves are determined by the one desired conditions so that a constant distance X is maintained during the whole working operation. As there are two hooks on the shaft, the diagram of FIG. 3 corresponds to 180° value. After 180° rotation, the speed of the extremity of the hook 4 nears a zero value and a second hook hits the rear flap of the next box blank being processed.

Figure 2:
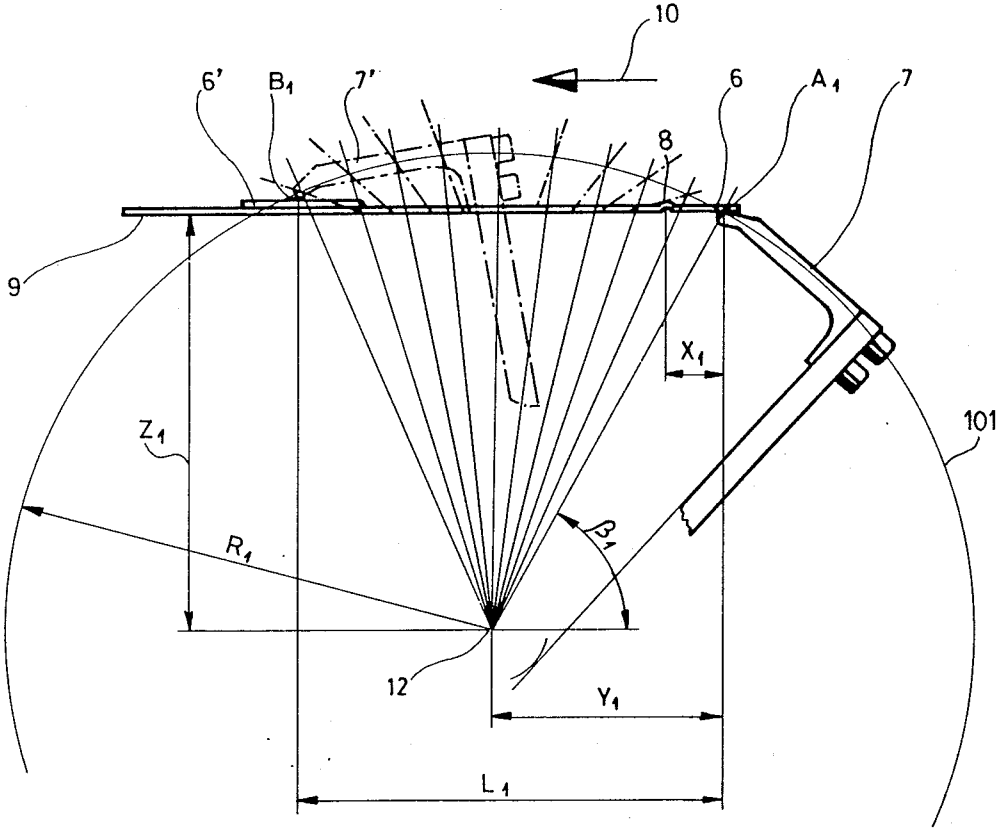
FIG. 2 is a schematic view similar to that of FIG. 1 showing the movement of folding a flap having a smaller dimension than the flap of FIG. 1.
Figure 3:
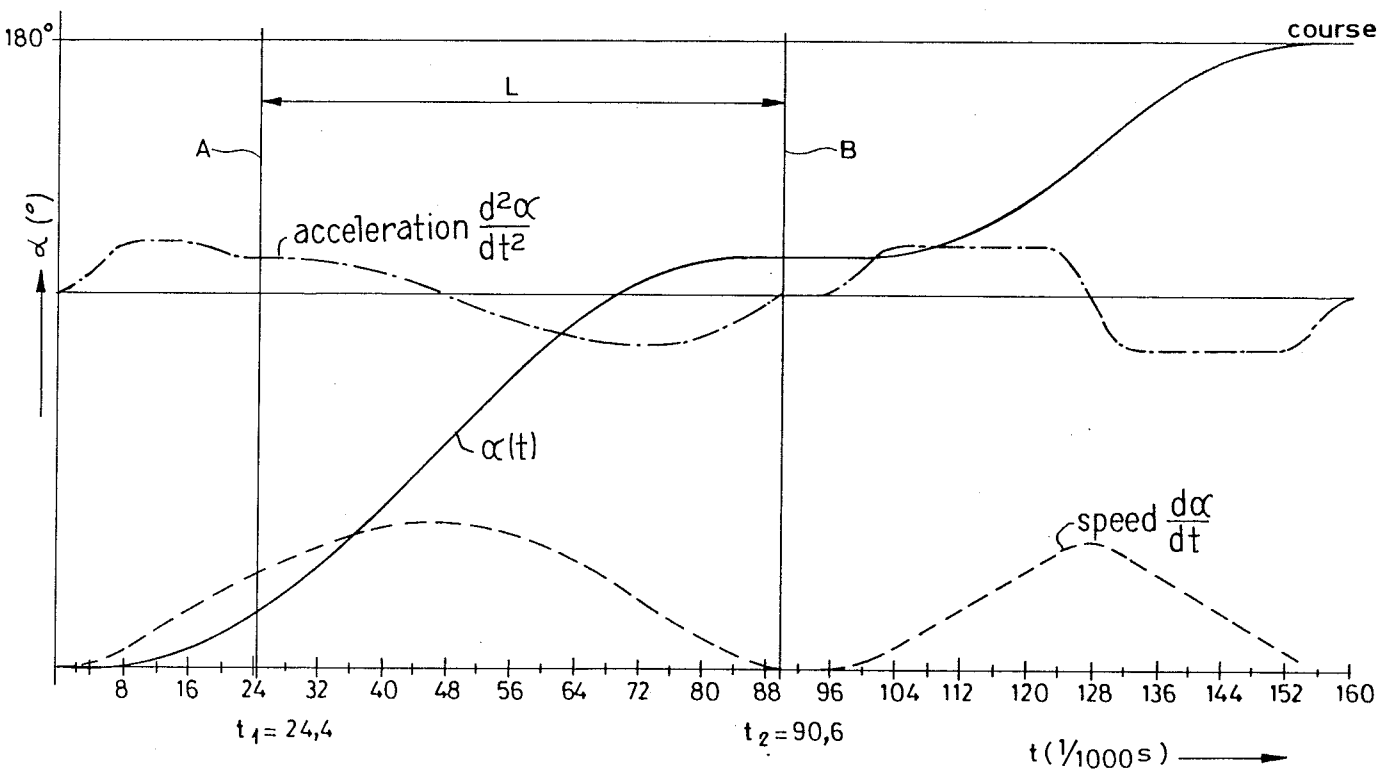
FIG. 3 is a graph showing the angle of rotation versus time with one path being the course of movement of the folding member, another path showing the speed of movement, and the third showing an acceleration of the folding member.
Figure 4:
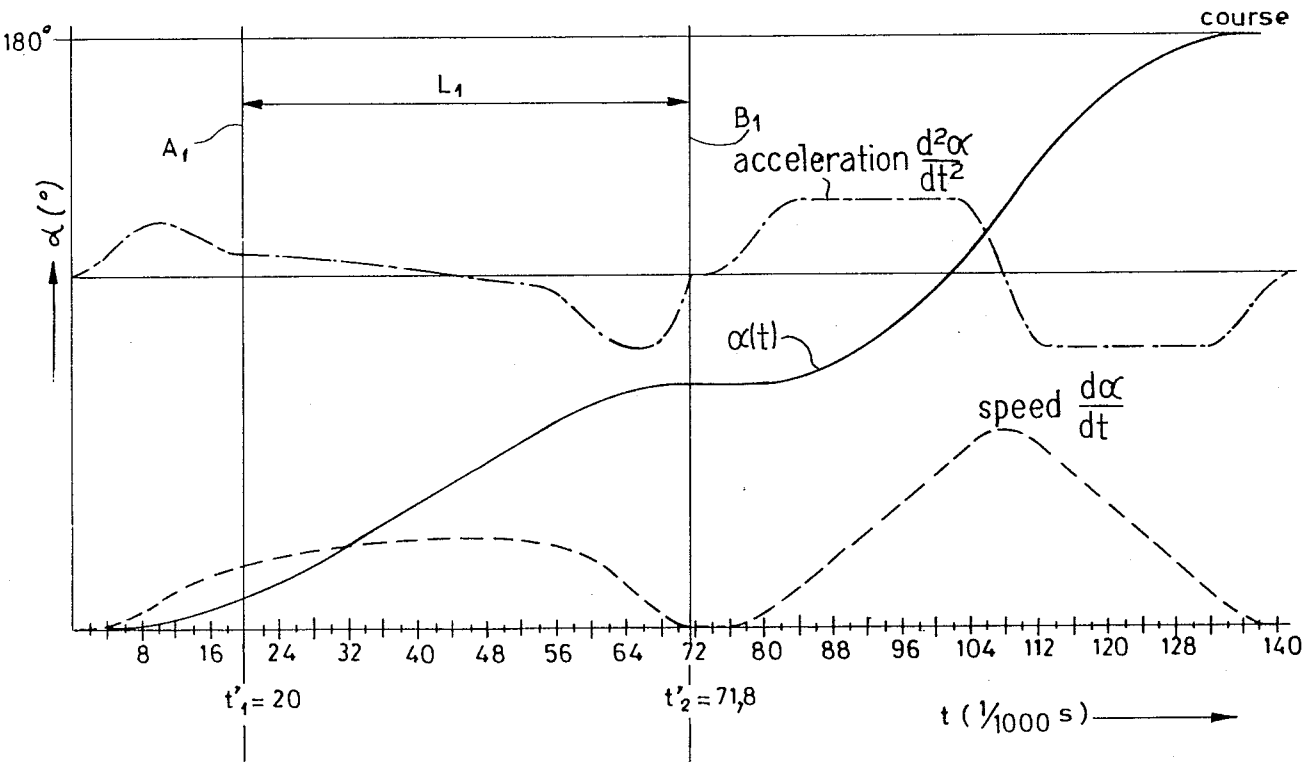
FIG. 4 is a graph similar to FIG. 3, illustrating the movement of the folding member, the change in speed, and the acceleration while folding a small rear flap, such as illustrated in FIG. 2.

When processing a small rear flap 6 of a blank 9, as illustrated schematically in FIG. 2, a hook 7 having the same size and dimensions as the hook 4 are utilized. The extremity of the hook 7 draws a circular curve or path 101 with a radius R1 equivalent to the radius R of hook 4. The value Y1 and Z1 have to be modified because the distance X1 has to be constant between the crease 8 and a hitting point A1 for the end of the hook 7. Here the acceleration and speed curves of FIG. 4 are also changed with regard to the same similar curves of FIG. 3. For processing small rear flaps 6, the working area L1 of the hook is smaller than the working area L of the hook 4. The rear flap 6 has, thus, to be hit at a speed almost equivalent to the running speed of the blank 9 while moving in a planar path in the direction of arrow 10 to maintain the previous condition. In the diagram of FIG. 4, the time 1/1000 seconds is reported on the x-axis and the rotational angle $\alpha$ of the shaft are set forth on the y-axis. At a time t'1=20 corresponds to the hitting point A1 of the end of the hook 7 against the rear flap 6 of the blank 9. The difference between t'1 and t'2 is equivalent to the value L1 of the working area for the hook 7. After a release point B1, the hook 7 is lying in the position 7' (see FIG. 2). As shown before, rotation of the hook 7 when in the position 7' has stopped to enable release of the folded blank 6'. FIGS. 1 and 2 show the angles $\beta$ and $\beta 1$ are not identical if the hitting points A and A' are different. These angles can, however, be calculated from any hitting point of the end of the hook against the rear flap of a box blank. The angles $\beta$ and $\beta n$ will be different for each length X and correspond to different rear flap lengths from a minimum to a maximum. The radius R is known and, thus, it is easy to calculate the distance Z for each value X. Thus, $Z=R \sin\beta$. As the length X has to be constant for the whole folding operation of the rear flap, the distance Z is then $Z=R-X$. Now the angle $\beta$ can be calculated by the formula $Z/R=\sin\beta=(R-X)/R$. Therefore, $Y=R \cos\beta=(Z+X)\cos\beta$.

Figure 5:
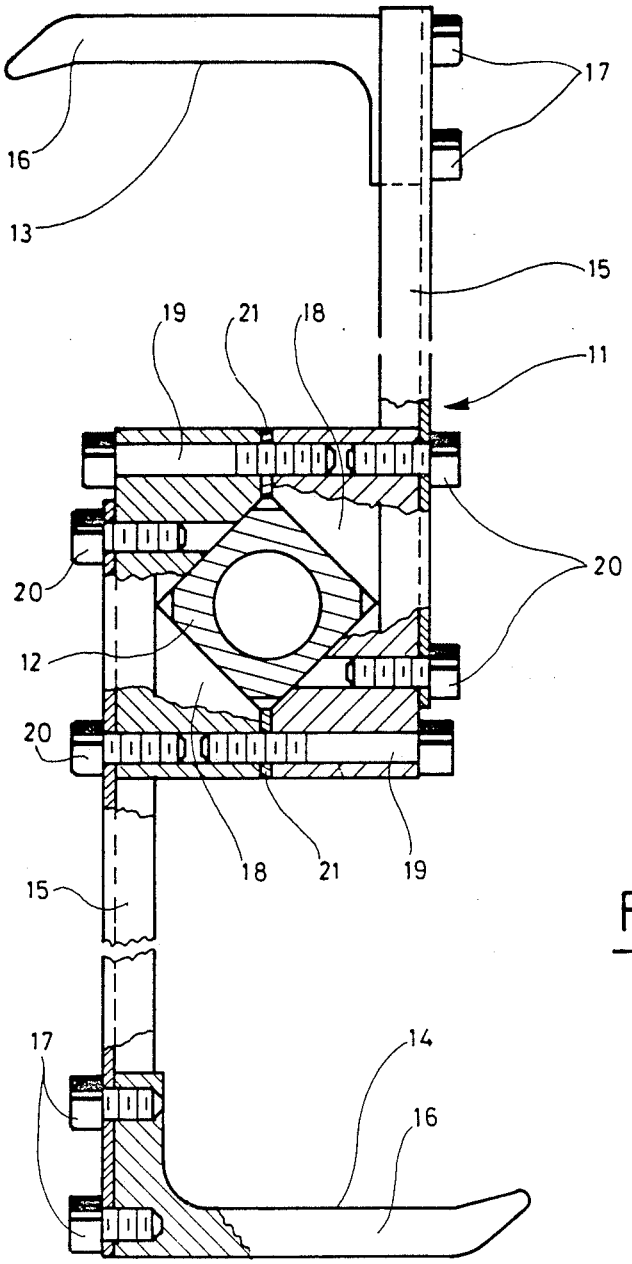
FIG. 5 is a cross sectional view of the drive shaft with portions broken away showing a pair of folding members in accordance with the present invention.

In FIG. 5, a rotative folder 11 is mounted on a transversal or drive shaft 12 which is formed of a thick hollow shaft which has been machined to have a square profile or cross section and is partially hollow to provide a lighter construction. The rotative folder 11 comprises two hook members 13 and 14. They each have an arm portion 15 formed of a channel member, and on the end a nose portion 16 which is secured thereto by screws 17. Each arm 15 is secured onto a half of a hub 18 by screws 20. The two half hubs 18 are secured together by screws or threaded fasteners 19 and to enable axial movement of the arrangement or rotatable member 11 on the shaft 12, spacers or shims 21 are provided between the half hubs 18. In a normal construction of the device for processing blanks, several rotative folders 11 are arranged one after another along the axis of the shaft to simultaneously process all the rear flaps of a box blank. The automatic lateral shifting of each of the rotative folders is achieved by a fork 22 (see FIGS. 6 and 7), which cooperates with a threading screw 23 driven by a stepping motor 24. To simplify the drawings of FIGS. 6 and 7, only one shifting device and only one rotative folder 11 have been represented.

Figure 6:
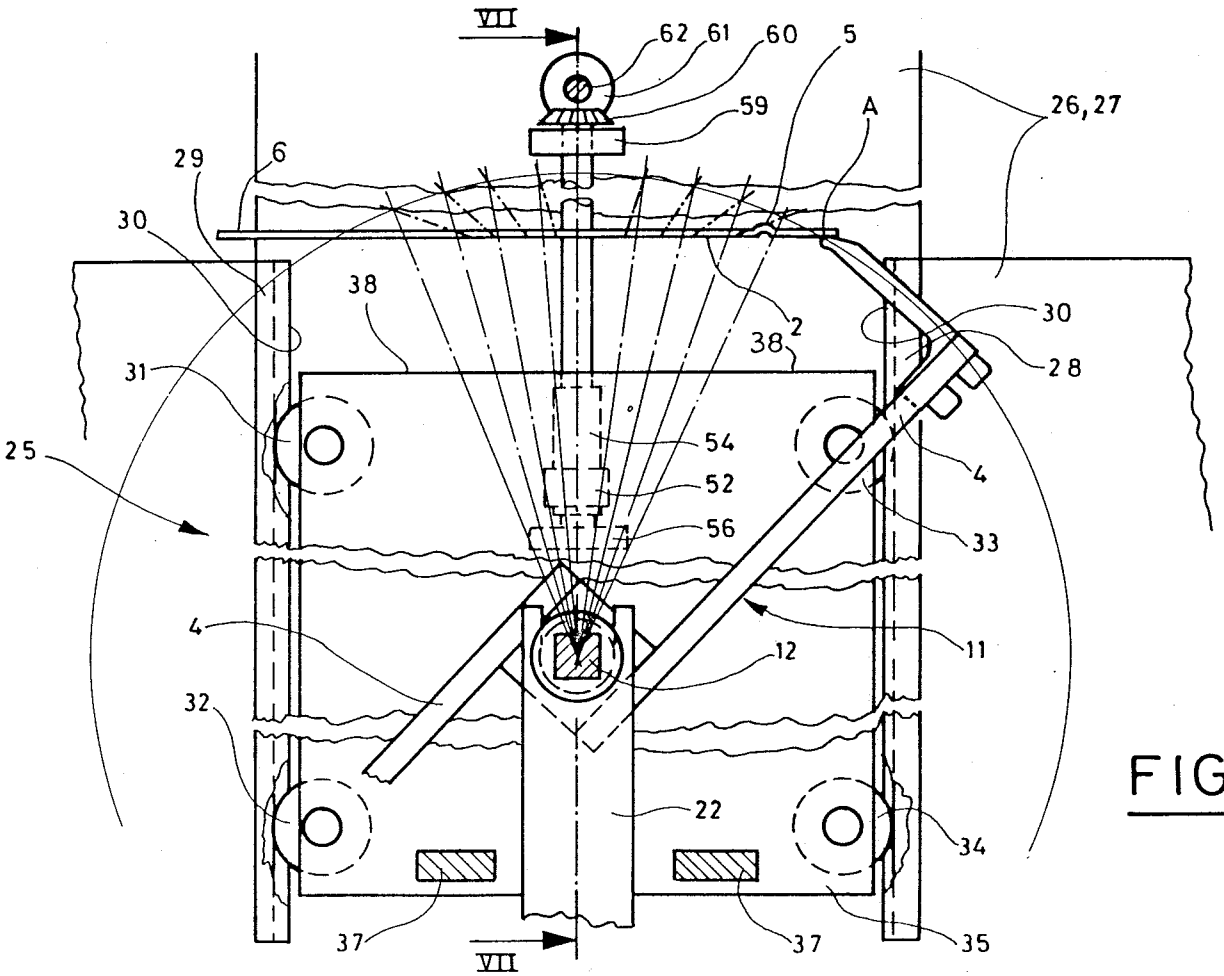
FIG. 6 is a side view with portions broken away for purposes of illustration of the folding device of the present invention.
Figure 7:
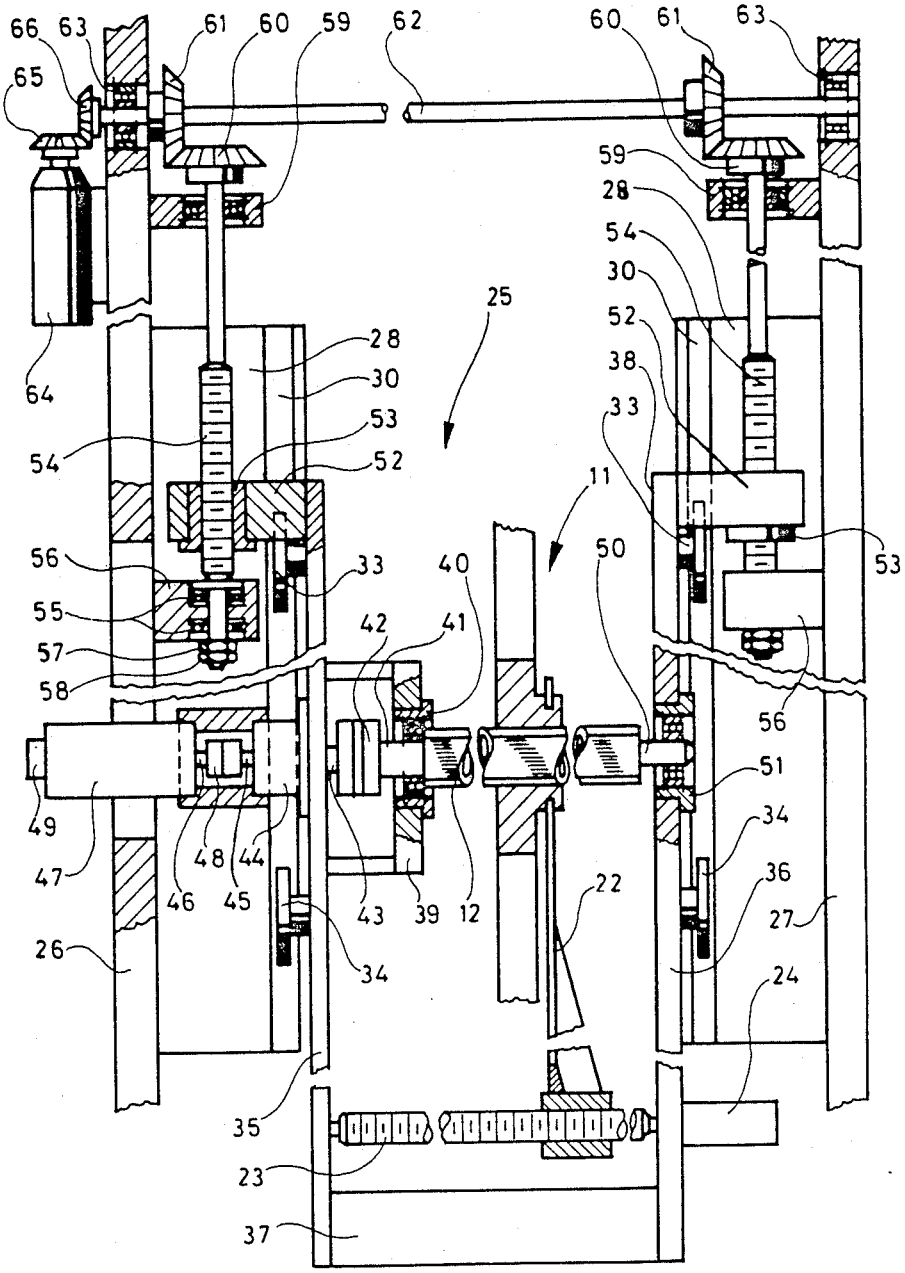
FIG. 7 is a cross sectional view taken along the lines VI—VI of FIG. 6.

In FIGS. 6 and 7, the folding device 25 is mounted in a cradle 38 between the lateral frames 26 and 27 of a folder gluer. Both of the lateral frames 26 and 27 are provided with two slides 28 and two slides 29, respectively, which slides 28 and 29 are each provided with a groove 30. The cradle 38 is formed by a pair of lateral cheeks or side plate 35 and 36, which are spaced apart, as illustrated best in FIG. 7, by crossbars 37. As illustrated, the cheek, such as 35, has four rollers 31, 32, 33, 34 with the rollers 31 and 32 being received in the groove 30 of the slide 29, while the rollers 33 and 34 are received in the groove 30 of the slide 28. In a similar manner, the cheek 36 has four rollers which are received in the same manner and, thus, allow the cradle 38 to move in a path extending substantially perpendicular to the path of the blank 6 moving through the device.

As best illustrated in FIG. 7, the inner face of the lateral cheek 35 is provided with a stirrup 39 which supports a ball bearing 40. The ball bearing 40 receives a machined end 41 of the transverse shaft 12 while the opposite end of the shaft 12 is machined to form an end 50 received in a bearing 51 mounted in the cheek 36. The end 41, after passing through the bearing 41 is engaged by a coupling 42 which is on an output shaft 43 of a speed reducer 44. The speed reducer has an input shaft 45 which is connected to an axle 46 of a drive motor 47 by a second coupling 48. The drive motor 47 is equipped with a pulse generator 49, * which gives an information about the angular position of the rotative folder. The linear speed of the blank is measured by another pulse generator (not shonw) and this value is used to modify the shape of the memorized speed (i.e. speed $(d\alpha)/(dt)$ in FIGS. 3 and 4.) With regard to the said linear speed of the blanks.

To shift the cradle 38 on the slides 28 and 29, a shifting means is provided. As illustrated, this means includes each of the cheeks 35 and 36 having on an outer surface a block or support 52 which receives a threaded member 53. A threaded shaft or setting screw 54 extends through the threaded member 53 and has an end engaged in a double roll stop 55 provided in a support 56 on an inner face of the lateral frames 26 and 27, respectively, of the folder gluer. The upper end of each of the setting screws has a shaft received in a bearing of a support 59 and terminates in a conical pinion 60. The conical pinion 60 engages a second conical pinion 61, which pinions 61 are on a transverse or control shaft 62, which is mounted for rotation in the frames 26 and 27 by bearings 63. The shaft 62 has a conical bearing 66 which engages a conical bearing 65 on a shaft of a stepping motor 64 which is mounted on an outer surface of the frame member 26 and is operated to rotate the shaft 62 to simultaneously rotate the two setting shafts 54 to move the cradle relative to the frames 26 and 27.

Figure 8:
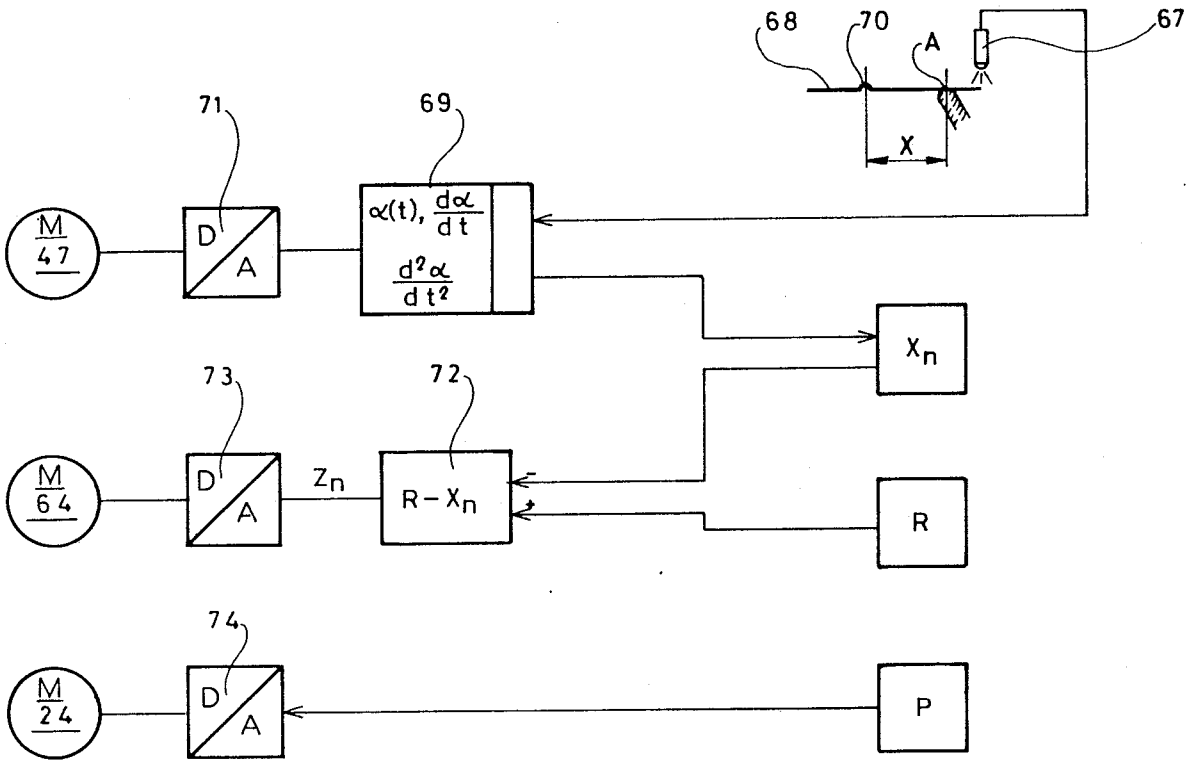
FIG. 8 is a schematic block diagram for the various motors of the drive means of the present invention.

A schematic diagram showing the controlling of the rotative folder 11 is illustrated in FIG. 8. The drive motor 47, which drives the rotative folder 11 is controlled by a photoelectric cell 67 which detects the rear edge of the blank 68. A pulse generator 69 is informed about the source of the motion by the detector which is combining the value Xn of the distance between a creasing line 70 and the hitting point A of the hook of the rotative folder 11 in order to obtain the value of the time t1 (see FIGS. 3 and 4). The generator 69 produces motion curves with regard to the following functions $\alpha(t)$ for the run or course of travel for the hook member; $d\alpha/dt$ for the speed of the hook member; and $d^2\alpha/dt^2$ for the rate of acceleration for the hook member. The values of these curves, either from FIGS. 3 or 4, are then sent to a pulse convertor 71, which converts them into the information which is acceptable by the drive motor 47.

In order to determine the vertical value Z for the vertical shaft 12 from the path of the box blank as illustrated in FIGS. 1 and 2, this value has to be reset with regard to the value X and determined by the hitting point A. Therefore, the value X, which is sent to the generator 67 is also sent, as illustrated, to a comparator 72, where it is subtracted from the value R for the radius, which is a constant, to obtain the value Zn for each wanted distance X. The value corresponding to value Zn is then sent to another convertor 73 which converts it into pulses that are applied to the stepping motor 64 for controlling the position of the cradle 38, as illustrated in FIGS. 6 and 7.

In order to axially position each of the rotative folders 11 on the shaft 12 to position the folder relative to the flap, a third convertor 74 converts the values P corresponding to location values of the concerned rotative folder into values acceptable by a stepping motor 24 for shifting the rotative folder.

The present invention thus allows an easy setting of the rotative folder as well as an automatic driving of the folder gluer to which it is associated. Thus, it improves the production of the machine by shortening the setup time when handling different styles or blanks.

Although various minor modifications may be suggested by those versed in the art, it should be understood that we wish to employ within the scope of the patent granted hereon, all such modifications as reasonably and properly come within the scope of our contribution to the art.

We claim:

1. In a device for folding a flap on a back edge of a box blank, said device including a frame means for conveying the blank along a path over the frame a rotatable shaft having two folding hook members facing in the same direction of rotation for engaging the rear flap and folding the flap over onto the blank as the blank moves along the path, the improvements comprising said hook member being axially adjustable on said shaft, said device including a cradle having two side plates being mounted in the frame for a sliding movement in a slide path extending perpendicular to the path of the blank, a drive motor being connected by a speed reducer to said rotatable shaft, said drive motor speed reducer and shaft being mounted in said cradle for movement therewith, and means for shifting the cradle on said slide path.

2. In a device according to claim 1, which includes means for axially changing the position of the hook members on the rotatable shaft.

3. In a device according to claim 2, wherein the means for shifting the cradle includes a setting screw engaging each of the side plates, a stepping motor driving a setting shaft, conical pinions on each of the setting screws coacting with conical pinions on the setting shaft so that each of the setting screws rotates in the same direction and the same amount.

4. In a device according to claim 3, wherein the means for axial changing of the hook members on the shaft includes a second stepping motor driving a shifting screw, a fork threadably received on the shifting screw and engaging the hook member.

5. In a device according to claim 4, which further includes a photoelectric cell for detecting the rear edge of the rear flap of a blank to create a value of a distance between a creasing line for the rear flap and a hitting point for engagement by an end of the hook member, said photoelectric cell being connected to a generator for generating information applied through a pulse convertor to said drive motor.

6. In a device according to claim 4, which includes means for determining the distance between a crease line for the rear flap and the point of contact with the folding member, said means supplying said value to a comparator subtracting said value from the radius of a circular path of movement for an end of the hook member, said difference being applied to a pulse converter to produce a pulse applied to said first stepping motor to shift said cradle and shaft to the desired position relative to the path of the blank.

7. In a device according to claim 1, wherein the two hook members are mounted on a rotatable member and the device includes means for axially changing the rotatable member on the drive shaft, said means for changing including a stepping motor rotating a shifting screw, a fork having a threaded member received on said shifting screw, said fork engaging the rotatable member so that rotation of the shifting screw by said stepping motor causes the rotative member to be shifted along the axis of said shaft.

8. In a device according to claim 1, wherein said means for shifting the cradle includes a stepping motor rotating a control shaft, a setting screw engaging each of the side plates of the cradle, and a plurality of conical pinions on said setting screws and control shaft for transferring rotation of the control shaft to said setting screws to vary the position of the cradle in said frame in response to operation of said stepping motor.

9. In a device for folding a flap on a back edge of a box blank, said device including a frame, means for conveying the blank along the path over the frame, a rotatable shaft having a rotatable member with two folding hooks facing in the same direction of rotation for engaging the rear flap and folding the flap over onto the blank as the blank moves along the path, the improvements comprising a cradle having two side plates being mounted in the frame for sliding movement along a slide path extending perpendicular to the path of the blank, a drive motor being connected by a speed reducer to the rotatable shaft, said drive motor, speed reducer and rotatable shaft being mounted in said cradle, means for shifting the cradle on said slide path including a separate setting screw for each of the side plates of the cradle, said setting screws terminating in conical pinions, a stepping motor driving a transverse axle, conical pinions on said transverse axle for engaging said conical pinions of the setting screws and means for laterally shifting the rotatable member with the two folding hook members along the axle of the drive shaft including a second stepping motor driving a shifting screw, a fork member being threadably received on said shifting screw and engaging the rotatable member so that rotation of the second motor shifts the hook members on said drive shaft.

* * * * *